US005217352A

United States Patent [19]

Haavik

[11] Patent Number: 5,217,352

[45] Date of Patent: Jun. 8, 1993

[54] TWO-STAGE LIQUID RING PUMP WITH ROTATING LINER IN FIRST STAGE SUPPORTED BY LIQUID FROM SECOND STAGE

[75] Inventor: Harold K. Haavik, Norwalk, Conn.

[73] Assignee: The Nash Engineering Company, Norwalk, Conn.

[21] Appl. No.: 875,297

[22] Filed: Apr. 29, 1992

[51] Int. Cl.[5] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 2,609,139 | 9/1952 | Kollsman | 230/79 |
| 4,323,334 | 4/1982 | Haavik | 417/68 |
| 4,334,830 | 6/1982 | Haavik | 417/68 |
| 5,100,300 | 3/1992 | Haavik | 417/69 |

FOREIGN PATENT DOCUMENTS

| | | | |
|---|---|---|---|
| 587533 | 11/1933 | Fed. Rep. of Germany . | |
| 1017740 | 10/1957 | Fed. Rep. of Germany . | |
| 212498 | 3/1941 | Switzerland . | |
| 219072 | 5/1968 | U.S.S.R. | 417/68 |
| 309155 | 7/1971 | U.S.S.R. . | |
| 1021815 | 6/1983 | U.S.S.R. . | |
| 1035290 | 8/1983 | U.S.S.R. . | |
| 1268809 | 11/1986 | U.S.S.R. . | |
| 1392249 | 4/1988 | U.S.S.R. . | |

*Primary Examiner*—Richard A. Bertsch
*Assistant Examiner*—Roland McAndrews
*Attorney, Agent, or Firm*—Robert R. Jackson; Robert W. Morris

[57] ABSTRACT

A two-stage liquid ring gas pump has a rotatable liner supported on a liquid bearing in the first stage housing. The liquid for the liner bearing is withdrawn from the second stage liquid ring and is therefore at a pressure which is high enough to support the liner for rotation without the need for any other component such as a liquid pump to pressurize it for that purpose.

12 Claims, 2 Drawing Sheets

TWO-STAGE LIQUID RING PUMP WITH ROTATING LINER IN FIRST STAGE SUPPORTED BY LIQUID FROM SECOND STAGE

BACKGROUND OF THE INVENTION

This invention relates to liquid ring pumps, and more particularly to two-stage liquid ring pumps with rotating housing liners.

Liquid ring gas pumps are well known, as shown, for example, by Haavik U.S. Pat. No. 4,323,334. The typical liquid ring pump includes a stationary annular housing in which a rotor having radially outwardly extending blades is mounted for rotation about an axis which is eccentric to the central longitudinal axis of the housing. A quantity of pumping liquid is maintained in the housing so that when the rotor is rotated, the blades of the rotor engage the liquid and form it into a recirculating ring inside the housing. Because the housing is eccentric to the rotor, the inner surface of this liquid ring alternately moves radially out from the rotor axis and then back in toward the rotor axis in the circumferential direction around the pump. Accordingly, the working spaces between adjacent rotor blades alternately expand (where the liquid which partly fills the spaces between those blades is moving radially out from the rotor axis) and contract (where the liquid between those blades is again moving inward toward the rotor axis) in the circumferential direction around the pump. Gas to be pumped is communicated to the expanding working spaces and the expansion of those spaces pulls the gas into the pump in the so-called intake zone of the pump. The subsequent contraction of the working spaces compresses the gas in those spaces in the so-called compression zone of the pump. The contracted working spaces then communicate with a pump discharge whereby the compressed gas exits from the pump. Liquid ring pumps may be used either as vacuum pumps or as compressors.

Two-stage liquid ring pumps are known in which the gas discharged from a first stage is conveyed to the intake of a second stage for further compression. For example, a typical two-stage liquid ring vacuum pump may be used to produce a reduced pressure of about 1" HgA at its first stage inlet. The first stage outlet and second stage inlet may be at about 4" HgA. The second stage outlet may be at atmospheric pressure (approximately 30" HgA). Exemplary two-stage liquid ring pumps are shown in Haavik U.S. Pat. Nos. 4,323,334 and 4,334,830.

An important source of energy loss and therefore inefficiency in liquid ring pumps is fluid friction between the rotating liquid ring and the stationary housing. One way to reduce such fluid friction loss is to include a rotatable liner between at least a portion of the liquid ring and the inner surface of the housing which would otherwise be in contact with that portion of the liquid ring (see, for example, Kollsman U.S. Pat. No. 2,609,139 and Haavik U.S. Pat. No. 5,100,300). The liner typically rotates at a speed which is a significant fraction of the speed of the liquid ring. The fluid friction loss between the liquid ring and the liner is therefore less than the fluid friction loss would have been between the liquid ring and the stationary housing. While such liners may be supported in other ways (e.g., on mechanical bearings), in the presently preferred pumps, the liners are supported on a fluid bearing in an annular clearance between the liner and the housing.

In order to ensure that a liner of the type described above is adequately supported for rotation by a fluid bearing, the bearing fluid should be at a pressure greater than the gas pressure differential in the associated portion of the pump. This gas pressure differential has the effect of pushing the liner out of concentricity toward the housing on the higher pressure side of the pump. In order to provide bearing liquid at a sufficiently high pressure, it may be necessary to augment the liquid ring pump with a separate pump for pressurizing the bearing fluid (e.g., a liquid pump for increasing the pressure of a portion of the pumping liquid which is introduced into the annular clearance between the liner and the housing as a bearing liquid for the liner). Such additional equipment tends to increase the cost and decrease the reliability of the liquid ring pump installation.

In view of the foregoing, it is an object of this invention to improve and simplify liquid ring pumps with rotating liners.

It is a more particular object of this invention to eliminate or at least substantially reduce the need for a separate pump for the bearing fluid which supports the rotating liner in at least some liquid ring pumps.

SUMMARY OF THE INVENTION

These and other objects of the invention are accomplished in accordance with the principles of the invention by providing two-stage liquid ring pumps in which the first stage has a rotating liner supported on bearing liquid which is pumping liquid withdrawn from the liquid ring in the higher pressure second stage of the pump. This liquid is at a sufficiently high pressure to fully support the liner in the first stage and prevent it from coming into rotation-inhibiting contact with the first stage housing. Accordingly, no separate liquid pump is required to provide pressurized bearing liquid for the first stage liner, at least once the liquid ring pump is in full operation.

Further features of the invention, its nature and various advantages will be more apparent from the accompanying drawing and the following detailed description of the preferred embodiments.

DETAILED DESCRIPTION OF THE PREFERRED EMBODIMENTS

Figure 1:
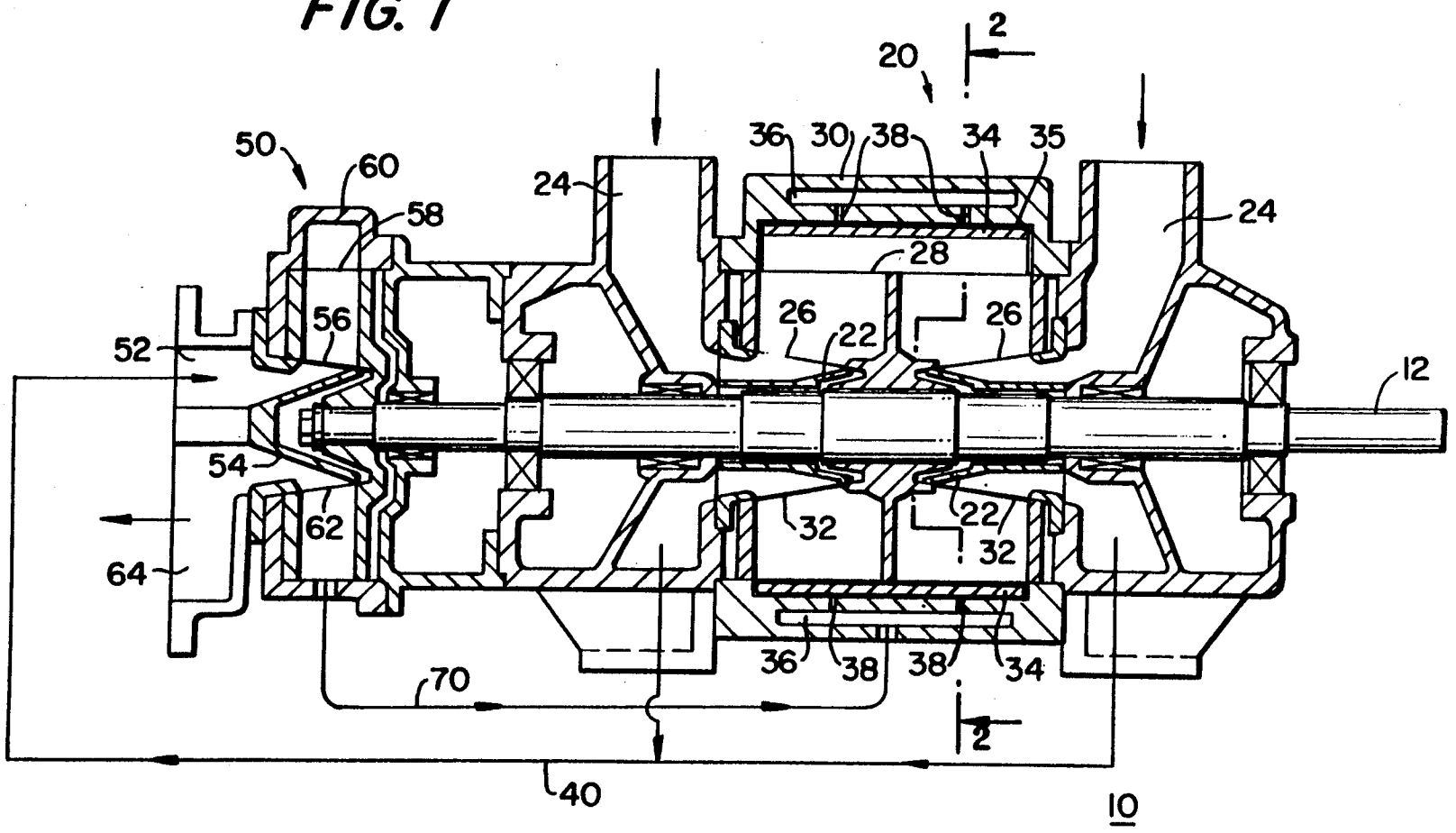
FIG. 1 is a simplified longitudinal sectional view of an illustrative two-stage liquid ring pump constructed in accordance with the principles of this invention.
Figure 2:
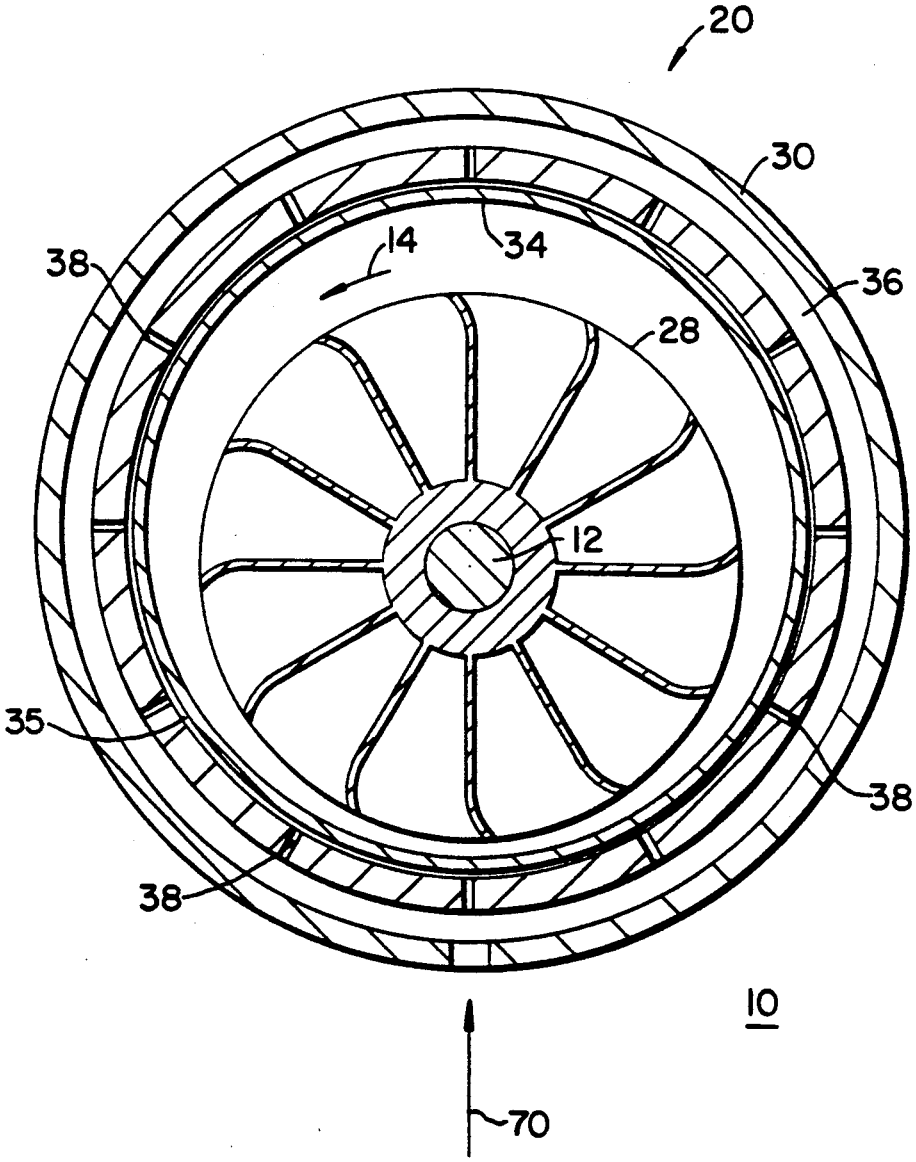
FIG. 2 is a simplified sectional view taken along the line 2—2 in FIG. 1.

As shown in FIGS. 1 and 2, an illustrative two-stage liquid ring pump 10 constructed in accordance with the principles of this invention includes a first stage 20 and a second stage 50. First stage 20 is double-ended, with a frustoconical port member 22 adjacent each axial end. Accordingly, gas to be compressed is admitted to the first stage via intake conduits 24. This gas enters the intake zone of the first stage via intake ports 26 in frustoconical port members 22. First stage rotor 28, mounted on shaft 12 and rotating with shaft 12 in the direction indicated by arrow 14 in FIG. 2, cooperates with the first stage liquid ring (not shown) in first stage housing 30 to convey this gas around to the opposite side of the pump, and at the same time to compress the gas being thus conveyed. The compressed gas exits from first stage rotor 28 via discharge ports 32 in port members 22, and flows to second stage inlet 52 via interstage conduit 40.

Second stage 50 is smaller than first stage 20 because it is handling gas which has already been compressed to some degree by the first stage. Accordingly, second stage 50 is single-ended and has only one frustoconical port member 54. Gas from second stage inlet 52 is pulled into the second stage via intake port 56 in port member 54. Second stage rotor 58 cooperates with the second stage liquid ring (not shown) inside second stage housing 60 to convey this gas around to the opposite side of the second stage, and at the same time to further compress that gas. The fully compressed gas exits from the second stage rotor via discharge port 62 in port member 54 and leaves the pump via discharge conduit 64.

First stage 20 has an annular rotatable liner 34 inside housing 30 for reducing fluid friction loss in the first stage in the manner discussed, for example, in Haavik U.S. Pat. No. 5,100,300. Liner 34 is concentric with the radially inwardly facing surface of housing 30 and is spaced from the surface of housing 30 by a small annular clearance 35. In the preferred embodiments, the radially inwardly facing surface of housing 30 is cylindrical, and liner 34 is a substantially rigid, hollow, cylindrical member. The substantially common central longitudinal axes of housing 30 and liner 34 are parallel to but laterally offset from the axis about which shaft 12 rotates.

Liner 34 is supported for rotation relative to housing 30 about the central longitudinal axis of the housing by pressurized bearing liquid in the above-mentioned annular clearance 35 between liner 34 and housing 30. Housing 30 includes an annular passageway 36 for distributing bearing liquid annularly around the first stage. Housing 30 additionally includes many relatively small radial passageways 38 for admitting pressurized bearing liquid from passageway 36 to clearance 35 at many points distributed angularly about and axially along the first stage. If liner 34 is adequately supported by the bearing liquid, the first stage liquid ring tends to rotate liner 34 with it relative to housing 30 due to the frictional drag of the liquid ring on the inner surface of liner 34, although the liner rotates at a somewhat lower speed than the average velocity of the liquid in the liquid ring. Rotation of liner 34 greatly reduces fluid friction losses in the pump by reducing the portion of the liquid ring which is in contact with stationary housing 30.

In order to ensure rotation of liner 34, the bearing liquid in clearance 35 must have sufficient pressure to substantially prevent liner 34 from contacting the housing at any point around the circumference of the pump. The gas pressure differential from one side of the first stage to the other acts through the liquid ring to tend to push liner 34 toward housing 30 adjacent the high pressure side of pump (i.e., approximately radially outward from discharge ports 32). Accordingly, the bearing liquid pressure must be at least great enough to overcome this effect of the gas pressure differential. For example, in a vacuum pump application of pump 10, first stage 20 may pump gas from a first stage inlet pressure of about 1" HgA to a first stage outlet pressure of about 4" HgA. The gas pressure differential in first stage 20 is therefore approximately 3" Hg, which is equal to approximately 1.5 psi.

In accordance with the present invention, bearing liquid having the pressure necessary to adequately support first stage liner 34 is withdrawn from the liquid ring in second stage 50 and conveyed to passageway 36 via conduit 70. Due to the higher gas pressure in second stage 50, the liquid in the second stage liquid ring is at a significantly higher pressure (e.g., 10 to 15 psi higher) than the liquid in the first stage. For example, in the above-mentioned situation, second stage 50 may raise the pressure of the gas being pumped from about 4" HgA to atmospheric pressure, which is a pressure increase of about 13 psi. The highest pressure in the second stage liquid ring is therefore about 13 psi higher than the highest pressure in the first stage liquid ring. This second stage pressure is adequate to overcome the pressure differential in the first stage which is tending to push first stage liner 34 out of concentricity with housing 30 and into rotation-inhibiting contact with that housing. Accordingly, at least when pump 10 is in normal steady-state operation, the liquid in conduit 70 can be used without further pressure increase (i.e., without a separate liquid pump) as the bearing fluid for liner 34.

The second stage liquid ring can be tapped at any location at which adequate pressure is available to provide the first stage liner bearing liquid. In the particularly preferred depicted embodiment, the second stage liquid ring is tapped at a radially outward location at or near the circumferential location having the highest pressure (i.e., adjacent second stage discharge port 62).

During start-up of pump 10, the pressure in conduit 70 may not be great enough to ensure the rotation of liner 34. The pump can therefore either be started without rotation of liner 34, or the pressure of the liquid in conduit 70 can be temporarily boosted by using a separate liquid pump. As another alternative, higher pressure bearing fluid from another source can be temporarily employed during start-up. It will be appreciated that start-up intervals for liquid ring pumps are typically relatively brief (e.g., a few minutes) as compared to the days, weeks, or months that such pumps are typically in uninterrupted normal operation.

It will be understood that the foregoing is merely illustrative of the principles of this invention, and that various modification can be made by those skilled in the art without departing from the scope and spirit of the invention. For example, although only a simple hollow cylindrical liner 34 is shown in FIG. 1, it will be understood that a liner with partly closed ends (as shown in Haavik U.S. Pat. No. 5,100,300) can be used if desired. Similarly, although the exemplary operating data given above is for a vacuum pump application of the invention, it will be understood that the invention is equally applicable to two-stage liquid ring pumps being used as compressors. As still another example of modifications within the scope of this invention, a rotating liner could be included in the second stage if desired. If that were done, it might be necessary or desirable to move the inlet of conduit 70 to an axial end member of second stage 50. It is noted, however, that the rotating liner is much more important to the first stage because the first stage liquid ring is much larger and because (at least in vacuum pumps) the first stage liquid ring typically has a higher speed due to the relatively low compression work being done on the gas in the high vacuum first stage.

I claim:

1. A two-stage liquid ring gas pump comprising:

a first stage having (1) a first stage housing, (2) a first stage rotor rotatably mounted in said first stage housing for cooperating with a first stage liquid ring in said first stage housing to compress gas from an inlet pressure to an interstage pressure, and (3) a liner mounted in said first stage housing for rotation relative to said housing, said liner being spaced from said first stage housing by an annular clearance;

means for conveying compressed gas from said first stage housing at said interstage pressure;

a second stage having (1) a second stage housing, and (2) a second stage rotor rotatably mounted in said second stage housing for cooperating with a second stage liquid ring in said second stage housing to further compress gas received from said means for conveying from said interstage pressure to an outlet pressure and thereby also pressurizing at least part of the liquid in the second stage liquid ring to a higher pressure than any liquid in the first stage liquid ring;

means for withdrawing liquid from said second stage liquid ring at approximately said higher pressure; and means for supplying the withdrawn liquid to said clearance at approximately said higher pressure where said liquid is used as a pressurized bearing liquid for supporting said liner for rotation relative to said first stage housing.

2. The apparatus defined in claim 1 wherein said second stage liquid ring pressurizes said withdrawn liquid sufficiently so that said withdrawn liquid supports said liner for rotation relative to said first stage housing without the need to further increase the pressure of said withdrawn liquid.

3. The apparatus defined in claim 1 wherein said second stage has a gas intake side where the pressure of the gas in said second stage is relatively low, and a circumferentially spaced gas compression side where the pressure of the gas in said second stage is relatively high, and wherein said means for withdrawing liquid from said second stage liquid ring withdraws said liquid from said compression side.

4. The apparatus defined in claim 1 wherein said means for withdrawing liquid from said second stage liquid ring comprises an aperture in said second stage housing radially outward from said second stage rotor.

5. The apparatus defined in claim 1 wherein said means for supplying the withdrawn liquid to said clearance comprises:

a plurality of apertures through said first stage housing in communication with said clearance, said apertures being circumferentially spaced around said first stage; and means for distributing said withdrawn liquid to all of said apertures.

6. The apparatus defined in claim 1 wherein said first stage housing includes a cylindrical inner surface portion, and wherein said liner comprises a substantially rigid, hollow, cylindrical member disposed concentrically inside said cylindrical inner surface portion.

7. The apparatus defined in claim 1 wherein said first stage has a gas intake side where the pressure of the gas in the first stage is relatively low, and a circumferentially spaced gas compression side where the pressure of the gas in the first stage is relatively high, and wherein said second stage liquid ring pressurized said withdrawn liquid to a pressure substantially greater than the difference between the pressure of the gas on the compression side of the first stage and the pressure of the gas on the intake side of the first stage.

8. The method of operating a two-stage liquid ring gas pump which includes (1) a first stage having (a) a first stage housing, (b) a first stage rotor rotatably mounted in said first stage housing for cooperating with a first stage housing to compress gas from an inlet pressure to an interstage pressure, and (c) a liner mounted in said first stage housing for rotation relative to said housing, said liner being spaced from said first stage housing by an annular clearance, and (2) a second stage having (a) a second stage housing, and (b) a second stage rotor rotatably mounted in said second stage housing for cooperating with a second stage liquid ring in said second stage housing to compress gas from said interstage pressure to an outlet pressure and thereby also pressurizing at least a part of the liquid in the second stage liquid ring to a higher pressure than any liquid in the first stage liquid ring, said method comprising the steps of:

withdrawing liquid from said second stage liquid ring at approximately said higher pressure; and applying the liquid withdrawn from said second stage liquid ring to said annular clearance at approximately said higher pressure as a pressurized bearing liquid for supporting said liner for rotation relative to said first stage housing.

9. The method defined in claim 8 wherein said higher pressure is in the range from about 10 to about 15 psi higher than the pressure of the first stage liquid ring.

10. The method defined in claim 8 wherein said first stage has a gas intake side where the pressure of the gas in the first stage is relatively low, and a circumferentially spaced gas compression side where the pressure of the gas in said first stage is relatively high, and wherein said higher pressure is substantially greater than the difference between the pressure of the gas on the compression side of the first stage and the pressure of the gas on the intake side of said first stage.

11. The method defined in claim 8 wherein said step of applying the liquid withdrawn from said second stage liquid ring comprises the step of:

distributing the liquid withdrawn from said second stage liquid ring to said clearance at a plurality of locations spaced circumferentially around said first stage.

12. The method defined in claim 8 wherein said second stage has a gas intake side where the pressure of the gas in the second stage is relatively low, and a circumferentially spaced gas compression side where the pressure of the gas in said second stage is relatively high, and wherein in said step of withdrawing liquid from said second stage liquid ring said liquid is withdrawn from said second stage liquid ring at a location which is radially adjacent said compression side.

* * * * *